United States Patent [19]

Iizuka

[11] 4,153,033

[45] May 8, 1979

[54] SYSTEM FOR DISABLING SOME CYLINDERS OF INTERNAL COMBUSTION ENGINE

[75] Inventor: Haruhiko Iizuka, Yokosuka, Japan

[73] Assignee: Nissan Motor Company, Limited, Yokohama, Japan

[21] Appl. No.: 810,906

[22] Filed: Jun. 28, 1977

[30] Foreign Application Priority Data

Jul. 30, 1976 [JP] Japan ..... 51/90235

[51] Int. Cl.[2] ..... F02B 3/10

[52] U.S. Cl. ..... 123/198 F; 123/32 EA; 74/857

[58] Field of Search ..... 123/198 F, 32 EA; 74/856, 857, 858, 861, 872

[56] References Cited

U.S. PATENT DOCUMENTS

| | | | |
|---|---|---|---|
| 2,623,617 | 12/1952 | Snyder et al. | 123/198 F X |
| 2,757,651 | 8/1956 | Winkler | 123/198 F X |
| 3,578,116 | 5/1971 | Nabeajima et al. | 123/198 F X |
| 4,061,055 | 12/1977 | Iizuka et al. | 123/198 F X |
| 4,064,844 | 12/1977 | Matsumoto et al. | 123/198 F X |

*Primary Examiner*—Ira S. Lazarus

*Attorney, Agent, or Firm*—Schwartz, Jeffery, Schwaab, Mack, Blumenthal & Koch

[57] ABSTRACT

Herein disclosed is a method and system for improving driveability of an automotive vehicle. The automotive vehicle has a multi-cylinder internal combustion engine provided with a cylinder disabling apparatus, a clutch, and a transmission. The method comprises the step of disabling the apparatus during a predetermined time period after the clutch is about to re-engage to permit all of the cylinders to operate under this condition and the system comprises means for performing this step.

3 Claims, 1 Drawing Figure

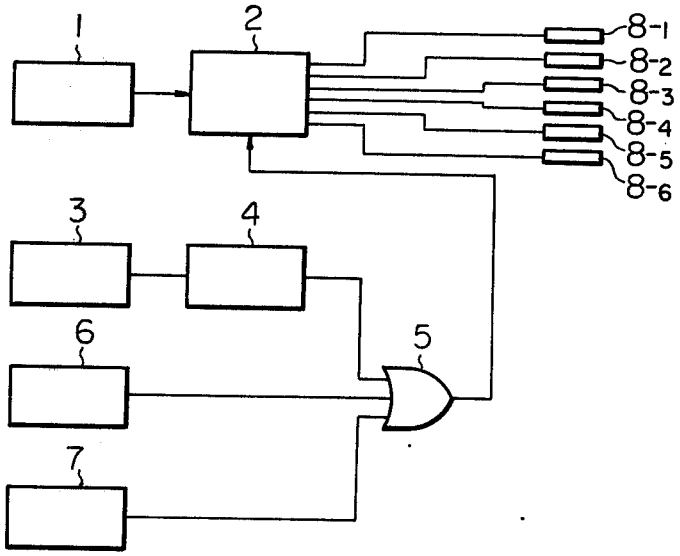
1
2
8-1
8-2
8-3
8-4
8-5
8-6
3
4
6
5
7

SYSTEM FOR DISABLING SOME CYLINDERS OF INTERNAL COMBUSTION ENGINE

BACKGROUND OF THE INVENTION

The present invention relates to a system for disabling some cylinders of a multi-cylinder internal combustion engine when the engine operates under light load, and more particularly to a method for improving driveability of an automotive vehicle including an internal combustion engine provided with such a system, a clutch, and a manual transmission, by reducing the vibration and/or a shock which would occur upon reengagement of the clutch.

A known cylinder disabling system is used in conjunction with a fuel-injection multi-cylinder internal combustion engine and it comprises an apparatus to cut the supply of fuel to some cylinders when load on the engine is lower than a predetermined load level. In an automotive vehicle having a multi-cylinder internal combustion engine provided with the system as above, a clutch, and a manual transmission, there is the drawback that, since the accelerator pedal of the engine is released upon disengagement of the clutch, causing the engine to operate on its reduced number of cylinders and thus lowering engine torque, a considerably large vibration and/or a shock is often perceived upon depressing the accelerator immediately after re-engagement of the clutch after the transmission has been shifted to a high gear. Another drawback is that there is an unacceptable delay in response to immediate acceleration demand after the transmission has been shifted to a high gear.

SUMMARY OF THE INVENTION

It is therefore an object of the present invention to provide a method and system for improving driveability of an automotive having a multi-cylinder internal combustion engine provided with a cylinder disabling system as described above, a clutch, and a manual transmission by reducing the vibration and/or a shock during engine operating condition just after or upon re-engagement of the clutch.

It is another object of the present invention to provide a method and system as above for disabling the cylinder disabling system upon re-engagement of the clutch to permit all of the cylinders to operate under this condition.

It is still another object of the present invention to provide a method and system as above for disabling the cylinder disabling system during engine operation at low engine revolution speeds to permit all of the cylinders to operate under this condition.

It is still another object of the present invention to provide a method and system as above for disabling the cylinder disabling system during warming-up of the engine to permit all of the cylinders to operate under this condition.

BRIEF DESCRIPTION OF THE DRAWING

The present invention will be further described in connection with the accompanying drawing, in which:

The single FIGURE is a circuit diagram showing a preferred embodiment of the present invention.

DESCRIPTION OF THE PREFERRED EMBODIMENT

Referring now to the FIGURE, a preferred embodiment according to the present invention is schematically shown as comprising a conventional fuel injection control unit 1 which generates injection pulses, each having a pulse width indicative of the appropriate amount of fuel to be injected under a given engine operating condition, in response to the engine revolution speed (rpm), the induction vacuum, the engine temperature and the like, which represent various engine operating conditions. These injection pulses are applied to six fuel injectors 8-1, 8-2, 8-3, 8-4, 8-5 and 8-6 for respective cylinders of a six-cylinder, fuel-injection type internal combustion engine. Designated by 2 is a conventional apparatus for disabling one or some cylinders of the engine by inhibiting the application of the injection pulses to the fuel injectors of these cylinders in response to sensed engine load. More particularly when the engine load is higher than a predetermined load level the fuel injection pulses are applied to all of the fuel injectors, while when the engine load is lower than the predetermined load level, the apparatus 2 prevents the application of the fuel injection pulses to some of the fuel injectors. As a result, the number of active cylinders reduces when the engine load is light, enabling the engine to reduce fuel consumption. Hence, engine operating efficiency in terms of fuel consumption increases.

As the apparatus 2, there are two possibilities, one being that the engine load is sensed by measuring the pulse width of one of the fuel injection pulses generated at the fuel injection control unit 1 to determine whether the engine load is lower than the predetermined load level, and another possibility being that the engine load is sensed by means of a load sensor which detects the intake air flow rate or the induction vacuum or the throttle opening degree.

Designated by 3 is a first module comprising a switch, such as a limit switch, that is closed when a clutch pedal, not shown, is depressed farther than a predetermined degree. The module 3 generates "1" output immediately after disengagement of the clutch by depression of the clutch pedal farther than the predetermined degree, and "0" output when the clutch pedal is released to engage the clutch.

A one-shot multivibrator 4 is circuited with the module 3 to receive the output from it. The one-shot multivibrator 4 is triggered when the output of the unit 3 lowers from "1" to "0" to generate at its output terminal "1" output for a predetermined time period, such as on 10 ms to the order of 100 ms. This output is fed to the apparatus 2 via an OR gate 5.

When "1" signal is fed to the apparatus 2, the apparatus 2 is disabled so that all of the cylinders become operative or active. Therefore upon re-engagement of the clutch, the fuel injection pulses generated at the fuel injection control unit 1 are applied to all of the fuel injectors 8-1 through 8-6 irrespective of the sensed load on the engine by the apparatus 2.

It will now be understood that since all of the cylinders of the engine operate upon re-engagement of the clutch irrespective of the magnitude of the sensed load by the apparatus 2, vibration and/or shock upon re-engagement of the clutch is reduced sufficiently and a delay in response to acceleration demand immediately after the re-engagement of the clutch is prevented.

Fed to another input terminal of the OR gate 5 is an output of a second module 6 which generates "1" output when the engine revolution speed (rpm) is lower than a predetermined rpm value. Fed to a third input terminal of the OR gate 5 is an output of a third module 7 which generates "1" output during warming-up operation of the engine, that is, when the enging temperature is lower than a predetermined engine temperature. The provision of the second and third modules 6 and 7 has made it possible to operate all of the cylinders of the engine during engine operation at low speeds and/or during warming-up operation of the engine. Thus stability of the engine under these operating conditions has been improved.

What is claimed is:

1. In an automotive vehicle, which includes a multicylinder internal combustion engine having a plurality of cylinders and associated therewith a plurality of fuel injectors to independently and respectively discharge fuel to said plurality of cylinders; a gear transmission; a clutch operatively interconnecting the engine and the gear transmission; a clutch pedal operatively connected to said clutch, said clutch normally connecting the engine with the gear transmission and being arranged to disengage the engine and the gear transmission upon depression of the clutch pedal; a fuel injection control unit operatively connected to the plurality of fuel injectors to supply fuel injection pulses thereto; and means for preventing the application of the fuel injection pulses to at least one of the plurality of fuel injectors, wherein said preventing means comprises:

a module means for producing a first logic signal upon depression of said clutch pedal beyond a predetermined point and for producing a second logic signal when said clutch pedal is between the totally undepressed position and said predetermined point of depression thereof;

a one shot multivibrator connected at the input thereof to the output of said module means, said multivibrator being so constructed and arranged as to enter a quasi-stable upon a change of the output from said module means from said first logic signal to said second logic signal; and an OR gate connected at one of the inputs thereof to the output of said multivibrator, wherein said preventing means is responsive to the output from said OR gate and is disabled for a period of time when said one shot multivibrator is in said quasi-stable state, whereby the application of the fuel injection pulses to said at least one of said plurality of fuel injectors is permitted for said predetermined time, and wherein said predetermined period of time is long enough to cover the period of time in which said clutch pedal returns from said predetermined point to the totally undepressed position upon release of said clutch pedal.

2. The invention as defined by claim 1, further comprising means connected to an input of said OR gate for generating a signal, equivalent to the output of said multivibrator in its quasi-stable state, when the engine revolution speed is lower than a predetermined level.

3. The invention as defined by claim 2, further comprising means connected to an input of said OR gate for generating a signal, equivalent to the output of said multivibrator in its quasi-stable state, when the engine temperature is lower than a predetermined temperature.

* * * * *